US006658803B2

(12) United States Patent
Szyjkowski

(10) Patent No.: US 6,658,803 B2
(45) Date of Patent: Dec. 9, 2003

(54) ACCESS DOOR MOUNTED ON PIVOTING FRAME

(75) Inventor: Jerzy Marek Szyjkowski, Caledon (CA)

(73) Assignee: Novera Products, Inc., Caledon (CA)

( * ) Notice: Subject to any disclaimer, the term of this patent is extended or adjusted under 35 U.S.C. 154(b) by 52 days.

(21) Appl. No.: 09/975,857

(22) Filed: Oct. 12, 2001

(65) Prior Publication Data

US 2002/0043033 A1 Apr. 18, 2002

Related U.S. Application Data

(60) Provisional application No. 60/245,588, filed on Nov. 6, 2000.

(51) Int. Cl.[7] ..... E05F 1/10

(52) U.S. Cl. ..... 52/213; 52/204.66; 52/205; 49/246

(58) Field of Search ..... 52/204.66, 213, 52/204.1, 205; 49/463, 465, 246, 247

(56) References Cited

U.S. PATENT DOCUMENTS

| | | | | |
|---|---|---|---|---|
| 14,680 A | | 4/1856 | Titus | |
| 2,108,238 A | * | 2/1938 | Strelow | 220/314 |
| 2,156,110 A | | 4/1939 | Brukner | |
| 2,562,551 A | * | 7/1951 | Henderson | 220/262 |
| 2,662,260 A | * | 12/1953 | Marschner | 411/551 |
| 2,882,580 A | | 4/1959 | Barsalou | |
| 3,286,405 A | | 11/1966 | Schembri | |
| 3,383,811 A | | 5/1968 | Ades | |
| 3,491,486 A | | 1/1970 | Caruth | |
| 3,665,958 A | * | 5/1972 | Dunkelis | 137/522 |
| 4,113,303 A | | 9/1978 | Yench | |
| 4,415,197 A | * | 11/1983 | Meyer | 296/216.02 |
| 4,890,418 A | | 1/1990 | Sachs | |
| 4,970,836 A | | 11/1990 | Brown | |
| 5,073,075 A | | 12/1991 | Duran | |
| 5,201,157 A | | 4/1993 | Thornton et al. | |
| 5,205,073 A | * | 4/1993 | Lyons, Sr. | 49/386 |
| 5,361,541 A | | 11/1994 | Szyjkowski | |
| 5,544,449 A | * | 8/1996 | Amelio et al. | 49/383 |
| 5,551,191 A | | 9/1996 | Maiwandi | |
| 5,765,312 A | | 6/1998 | Szyjkowski | |
| 6,213,535 B1 | * | 4/2001 | Landmesser et al. | 296/146.12 |

FOREIGN PATENT DOCUMENTS

| | | |
|---|---|---|
| GB | 1134151 | 11/1968 |

* cited by examiner

*Primary Examiner*—Carl D. Friedman
*Assistant Examiner*—Basil Katcheves
(74) *Attorney, Agent, or Firm*—Young & Basile P.C.

(57) ABSTRACT

An access door is suitable for installation in a structure such as a building and allows ready access to an enclosed region of the structure. The access door includes a door frame that can be mounted on the structure and that forms an access opening. A panel removably covers the access opening on an exterior side of the door frame. Two parallel connecting links are pivotably connected both to the door frame and to the panel in a manner permitting the panel to be moved from an open position where the access opening is uncovered to a closed position where the panel covers the access opening. A frame member connects the two links together in a rigid manner. One or more threaded fasteners can be used to detachably connect the panel so that it is secured in the closed position. In one embodiment, a single screw can detachably connect the panel to a pivotable connecting frame that includes the two links. In another version, the panel can be detachably and directly connected to the door frame by fasteners.

16 Claims, 2 Drawing Sheets

ACCESS DOOR MOUNTED ON PIVOTING FRAME

This application claims convention priority on the basis of Canadian application No. 2,324,665 filed Oct. 13, 2000 and claims domestic priority on the basis of U.S. provisional patent application No. 60/245,588 filed Nov. 6, 2000.

FIELD OF THE INVENTION

Background of the Invention

This invention relates to access doors which can be used to cover openings or spaces in a structure such as a wall or ceiling and which can provide ready access to a space or installation located behind the wall or ceiling.

It is commonly known in the building and architectural trades to provide access doors in order to permit ready access to an installation or space located behind a wall or above a ceiling. Often it is necessary to gain access to the space in order to carry out routine maintenance or repairs to an installation or device located in an enclosed space. A common type of access door incorporates a door frame and a hinged panel member or door mounted on the door frame. Such an access door may be provided with any of several types of locking devices in order to hold the panel or door in place. The lock device can take the form of a common latch, a hook or a slidable bar or pin. These known doors are generally designed to be simple to use and often little thought has been given to their external appearance or to the installation methods that must be used.

The known access doors that have been used in th past can suffer from a number of deficiencies. For example, because of the manner in which the door is opened, they may not provide for full use of or full access to the opening behind the access door. This is commonly due to the problem of the panel member or door in the open position still occupying a significant area of the access opening. In addition, the door frame itself may occupy a significant portion of the original opening or hole in the structure.

An additional difficulty with some known access doors is that they are installed from inside the door opening by putting screws or nails through holes provided in an internal flange of the door frame. This can be quite inconvenient for an installer due to such factors as the visibility in the work area, the very limited available space in which to work, and the angle of installation. As a result of these difficulties, the installation of these access doors is often faulty. For example, the access door frame may not be firmly and rigidly installed or there may be gaps between the inner surface of the external flange of the door frame and the surface of the wall.

It is an object of the present invention to provide an improved access door apparatus that includes both a door frame and a movable panel or door and that is relatively easy to install and use as well as being inexpensive to manufacture.

It is a further object of the present invention to provide an improved access door apparatus which includes both a door frame and a panel member or door and which permits the user to have clear access to an enclosed space or installation through an access opening formed by the door frame.

It is a further object of the invention to provide an access door apparatus which has a pleasing appearance after installation.

SUMMARY OF THE INVENTION

According to one aspect of the invention, an access door apparatus for installation in a structure such as a building includes a door frame adapted for fixed mounting in the structure and forming an access opening. The apparatus further includes a removable panel for covering the access opening on an exterior side of the door frame and a pivotable connecting frame arrangement joining the panel to the door frame. The connecting frame arrangement has inner and outer ends which are respectively pivotably connected to the door frame and to the panel. The frame arrangement includes two, substantially parallel connecting links pivotably connected to opposite sides of the door frame and to the panel. An interconnecting frame member extends between and rigidly interconnects the links. The panel can be moved from an open position where the access opening is at least substantially uncovered and open to a closed position where the panel covers the access opening in a close fitting manner.

One preferred form of access door of the invention includes a fastening mechanism for detachably connecting the panel to the connecting frame arrangement when the panel is in the closed position whereby the panel is secured in the closed position.

According to another aspect of the invention, an access door for covering an aperture in a structure in a manner that permits future access through the aperture includes a door frame adapted to be fixedly mounted at the aperture and to the structure. This door frame has frame walls extending around and defining an access opening. The apparatus also has a panel member capable of covering at least the access opening on an exterior side of the door frame and having at least one fastener hole formed therein. There are also two pivotable connecting links joining the panel member to two of the frame walls disposed on opposite sides of the access opening. Each of these links has an inner end pivotably connected to an inner surface of its respective frame wall and an outer end pivotably connected to a respective lug provided on an inner surface of the panel member. There is also a rigid frame member extending between and rigidly connecting the two connecting links whereby the two connecting links pivot with each other. The panel member can be moved from an open position where the access opening is uncovered and open to a closed position where the panel member covers the access opening. During use of this apparatus, at least one fastener extending through the at least one fastener hole can be used to secure the panel member in the closed position.

According to still another aspect of this invention, an access door apparatus for covering an aperture in a structure in a manner which permits future access through the aperture, includes a door frame adapted to be rigidly mounted at the aperture and to the structure. This frame extends around and defines an access opening. A panel member capable of covering at least the access opening on a front side of the door frame has pivot mounts provided thereon and two connecting links are each pivotably connected to a respective one of these pivot mounts at an outer end thereof. Each link is pivotably connected to the door frame at an inner end thereof and is arranged so that the links are on opposite sides of the access opening. The links permit the panel member to be moved from an open position where the access opening is completely uncovered and the panel member is spaced apart from the access opening to a closed position where the panel member covers the access opening. The panel member is free to pivot on the connecting links when the links are stationary and are in a position where outer ends thereof are away from the access opening. A rigid frame member extends between and rigidly connects the two links whereby the links pivot with each other. This door apparatus includes means for holding the panel member in the closed position, this holding means comprising at least one threaded fastener and a threaded hole provided on the rigid frame member.

Further features and advantages will become apparent from the following detail description taken in conjunction with the accompanying drawings.

DETAILED DESCRIPTION OF PREFERRED EMBODIMENTS

Figure 1:
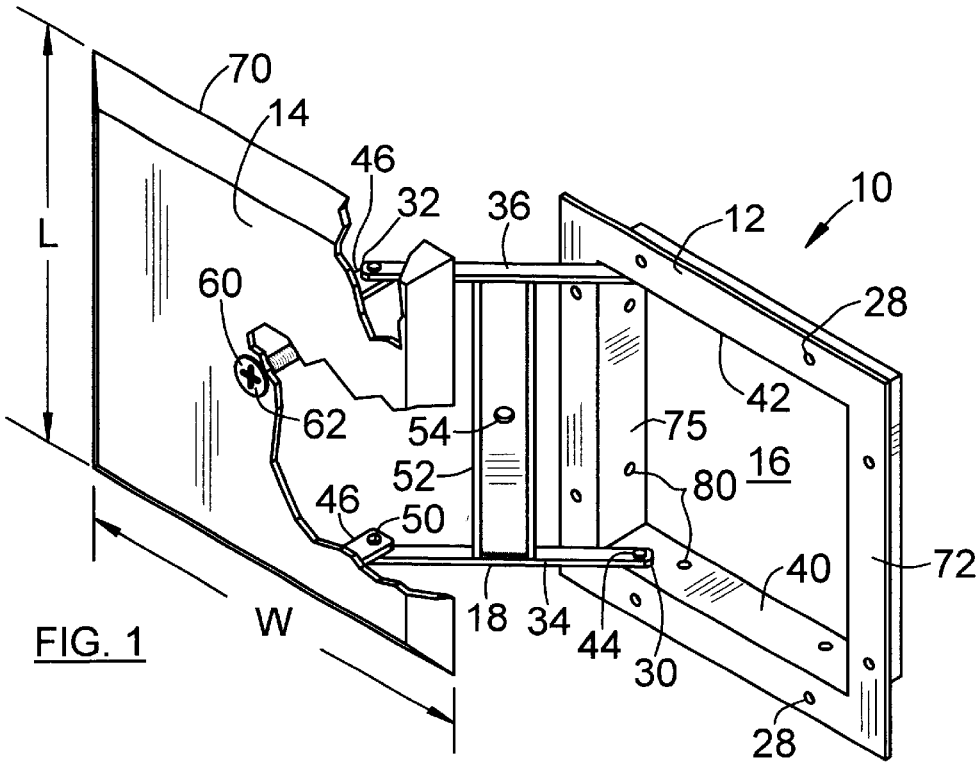
FIG. 1 is a perspective view of a first embodiment of an access door constructed in accordance with the invention, this view showing the door panel in a substantially open position and showing the door panel partially broken away for purposes of illustration.
Figure 2:
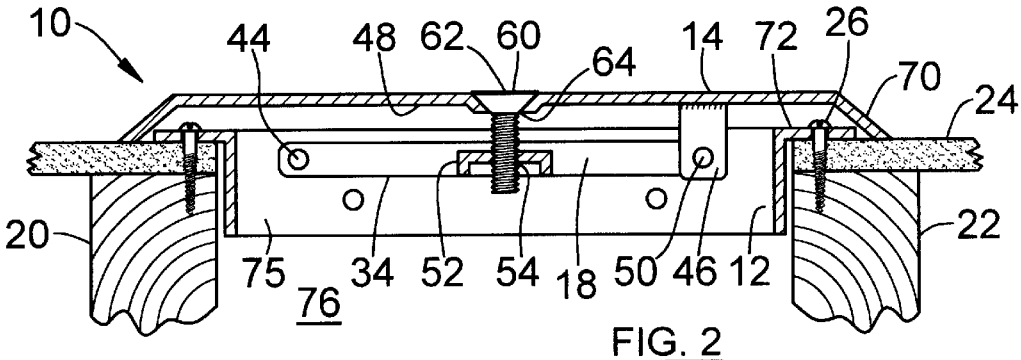
FIG. 2 is a cross sectional view of the access door of FIG. 1, this view being taken along a horizontal plane extending through the centre of the door panel and showing the door panel in the closed position.
Figure 3:
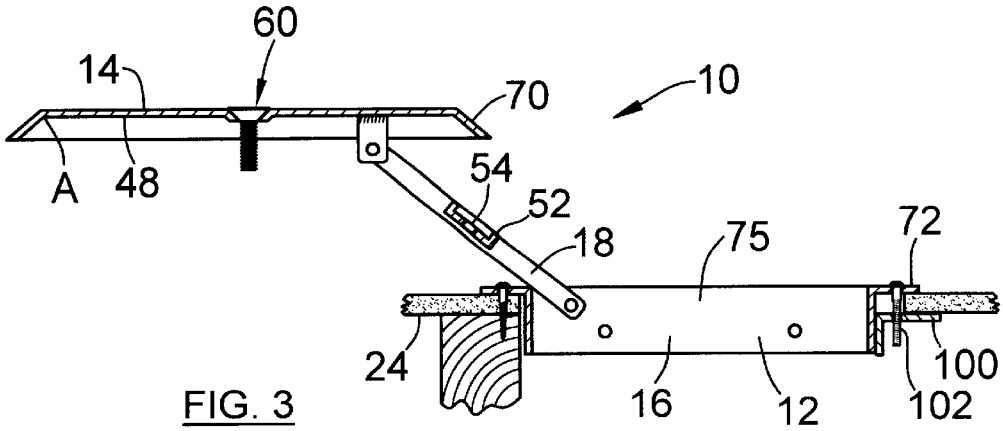
FIG. 3 is a cross-sectional view of the access door of FIG. 1, this view again being taken along a horizontal plane extending through the centre of the door panel and this view showing the door panel in the open position.

An access door apparatus 10 is illustrated in FIGS. 1 to 3 and is shown in both open and closed positions. This apparatus 10 is designed for installation in a solid structure such as a building. It can, for example, be rigidly mounted in a wall or a ceiling of a building in order to permit access to a space behind the wall or about the ceiling. Such access may, for example, be required in order to reach an equipment installation for purposes of repair or maintenance. There are many other examples and situations where access doors of this type can be used. Another example would be to permit the viewing of a gauge or meter from time to time, this gauge or meter being located in a space behind the wall or in a ceiling space.

The apparatus 10 comprises three primary components including a door frame 12 which is adapted for fixed mounting to support members of the structure (or to panelling as explained below), a panel or door 14 for removably covering an access opening 16, and a pivotable connecting frame arrangement indicated generally at 18. In FIG. 2, the door structure is shown mounted to a wooden stud 20 and to another wooden support member 22 which can be the same as or different from the stud 20. The stud 20 or support 22 could also be made of metal. Covering the studs is a wall panel or ceiling panel 24. In the case of an inner wall structure, the panel 24 can be wallboard or it can be wooden panelling. The door frame 12 is shown in FIG. 2 as attached to the panel 24 and to the support members 20, 22 by means of standard screws 26 which extend through screw holes 28 formed in the door frame. By using this form of connection, the screws can be installed conveniently from the front onto studs or other supports instead of having to install the screws from the inside of the door frame 12. Attaching the door frame by using the screws 26 in this manner has the additional advantage of having the door frame 12 being driven tight to the surface of the wall or ceiling by the screws. It will be understood that the access door apparatus 10 can be used for many various types of installations and in a variety of structures other than that shown in the drawings.

The panel or door 14 is mounted so as to cover the opening 16 on an exterior side of the door frame. The panel, which is preferably rectangular or square as shown, is preferably sized so as to at least cover the access opening 16. However, as illustrated in FIG. 2, in a particularly preferred embodiment of the present invention, the panel is sized so that it will also cover the exterior of the door frame. In other words, the panel 12 has a width indicated at W and a length L which are larger than corresponding outside dimensions of the door frame 12. The panel can be moved from an open position shown in FIG. 3 where the access opening 16 is at least substantially uncovered and open (and preferably completely uncovered) to a closed position shown in FIG. 2 where the panel covers the access opening in a close fitting manner. It is also possible for the width W and length L of the panel 12 to be less than the outside dimensions of the door frame so that even with the panel 12 in the closed position, at least edges of the door frame can still be seen.

The preferred connecting frame arrangement 18 has inner ends 30 and outer ends 32 which are respectively pivotably connected to the door frame 12 and to the panel 14. The connecting frame arrangement 18 includes two substantially parallel connecting links 34 and 36 which can be made of a rigid metal such as steel, stainless steel, bronze or aluminum alloy. One of these links is connected to one side of the door frame 12 on the first inner surface 40 that extends along one side of the access opening 16 and the other link 36 is connected to an opposite side of the door frame on a second inner surface indicated at 42 that extends along an opposite side of the access opening. The inner end of the link can be pivotably connected to its respective inner surface by a short pivot pin 44. The pivot pin can be provided by a suitable rivet, preferably a step rivet for the best operation, or a bolt and nut combination. The outer end of each link is preferably connected to the panel or door by means of a connecting lug 46 formed on or connected to an inner surface 48 of the panel. A pivot pin can extend through the outer end of the link and the respective lug. This pivot pin 50 again can take the form of a rivet, preferably a step rivet, or a bolt and nut combination, or another type of fastener. The connecting frame arrangement 18 preferably includes a rigid, interconnecting frame member 52 which, as illustrated, can be a channel member, if desired. This frame member 52 extends between and rigidly connects the two links 34, 36 and thus ensures that the links move in unison at the same time. If desired, the frame member 52 can be welded at each end to the inner sides of the links. Another form of frame arrangement 18 can be made by a single stamped metal profile made from a single piece of sheet metal. The illustrated frame member 52 is preferably connected to a central section of each link but other locations are possible and it is also possible to use more than one connecting frame member. Preferably the connecting frame member is located so as not to interfere with access through the opening 16 when the door or panel is in the open position. The frame member 52 can be formed with a central, threaded screw hole 54 for the purpose described below. The connecting frame arrangement 18 permits the panel to be moved completely away from the access opening and also to either side of the access opening. In the fully open position shown in FIG. 3, the panel is spaced a short distance from the opening 16 and does not block any portion of this opening. In some applications, it is possible to omit the frame member 52 so that the links are not interconnected. For example, this is possible with some versions of the embodiment of FIGS. 4 and 5 (described below) in which there is no screw to connect the panel 12 to the frame member 52.

The preferred access door apparatus 10 includes a fastening mechanism indicated generally at 60 for detachably connecting the panel 14 to the connecting frame arrangement 18 when the panel is in the closed position, whereby the panel is secured in this closed position. As illustrated, this fastening mechanism can comprise a single threaded fastener, such as a screw 62, that can extend through a first screw hole 64 formed in the panel, preferably in the centre of the panel, and through a second screw hole, namely the aforementioned hole 54 in the interconnecting frame member 52, in order to detachably connect the panel to the connecting frame arrangement 18 when the panel is in the closed position (see FIG. 2) and thereby secure the panel in this closed position. If desired, two or more of the screws 62 could be used along with corresponding screw holes instead of just one screw. A standard screw retainer (not shown) can be mounted, if desired, on the screw 62 on the inner side of the panel and near the screw head in order to hold the screw 62 in its hole at all times and thus prevent its accidental loss when the panel is in the open position. An alternative construction for securing the panel or door 14 in place in the closed position will be described hereinafter with reference to FIGS. 4 and 5.

The preferred panel 14 is made from sheet metal but it could also be made from wood or plastic. In the case of metal panels, the sheet metal chosen will depend to some extent on the use of and location of the access door apparatus. Where weight is not a problem and where a strong panel is desired, a steel panel, a galvanized steel panel or a stainless steel panel can be used. Where a light weight panel is desirable and a very strong panel is not necessarily required, the panel can be made from aluminum alloy.

The preferred panel or door 14 has an edge section 70 extending around the periphery of the panel. This edge section can be formed by bending an edge strip of the panel along each of its edges as shown so that the edge section extends inwardly a distance measured perpendicular to the inner face 48 of the panel which is at least as large or larger than the thickness of an outwardly extending flange 72 formed on the door frame. If the heads of the screws 26 project above the flange surface then the inward projection of the edge section should be sufficient to equal the thickness of the flange 72 and the height of the screw head. The flange 72 is arranged so as to extend over an exterior surface of the wall or ceiling during use of the access door. It will be seen that by making the panel 14 larger than the outside dimensions of the door frame, the holes 28 and the screws 26 in these holes are hidden when the panel is in the closed position and this results in a pleasing, aesthetic appearance. Although it is possible for the edge section to extend perpendicular to the inner surface 48 of the panel, preferably the edge section extends at an obtuse angle to this inner surface as shown. This obtuse angle indicated at A in FIG. 3 can, for example, be 135 degrees. By the use of a sloping edge section, when the central screw 62 is tightened to secure the panel in place, the edge section 70 will tend to bend or pivot outwardly as it is pushed against the exterior surface of the wall or ceiling. In this way, the edge section will preferably press against the adjacent surface of the wall and ceiling, thereby eliminating any gaps between the edge of the panel and the adjacent surface of the wall or ceiling and resulting in a tight fit between the panel and the surface of the wall or ceiling.

Turning to the construction of the door frame 12, as indicated, the preferred frame includes a peripheral mounting flange 72 which helps in properly locating and holding the access door apparatus 10 in the hole or aperture formed in the wall or ceiling. This mounting flange is formed with the aforementioned screw holes 28 that permit the door frame to be directly attached to the exterior surface of the wall or ceiling by means of the illustrated screws 26 or, alternatively, by suitable nails (now shown). The preferred illustrated door frame 12 has four sides with each side being substantially L-shaped in cross-section as shown in FIG. 2. Each side is formed with an inner wall 75 adapted to extend into the opening or hole 76 formed in the structure, ie. the wall or the ceiling, and the above described exterior flange 72 that extends outwardly from the access opening 16. It will be understood that the inner walls or frame walls 75 extend around and effectively define the access opening 16. The inner wall 75 can be formed with additional fastener holes 80 as shown in FIG. 1 which can be used, if desired, to connect the apparatus 10 to adjacent support members such as a wall stud or ceiling beam. This conventional type of connection can be used as an alternative to or in addition to the connection method employing the screws 26 and the holes 28 on the flanges. The preferred metal door frame can be made by a standard, metal stamping process. This process can provide a radius or rounded corner (not shown) where each flange 72 meets the inner wall and this radius construction may be used (if desired) in place of the sharp corners shown.

Figure 4:
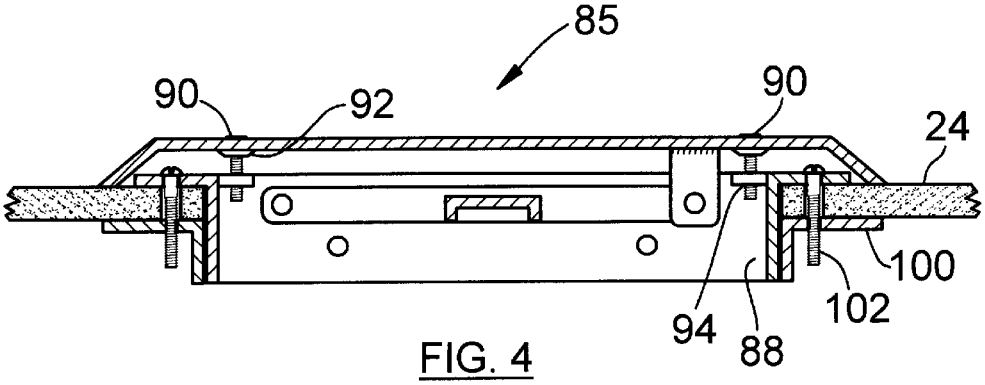
FIG. 4 is a cross-sectional view similar to FIG. 2 but showing another embodiment of the invention with the door panel in the closed position.
Figure 5:
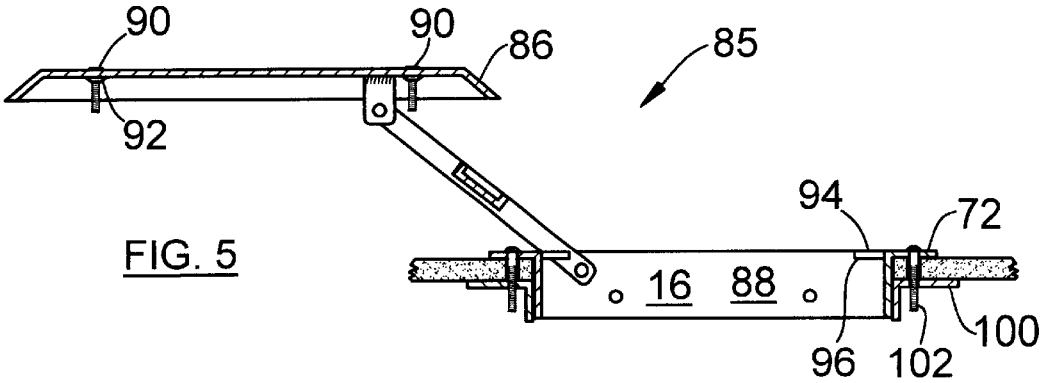
FIG. 5 is a cross-sectional view similar to the cross-section of FIG. 3 but showing the embodiment of FIG. 4 with the door panel in the open position.

FIGS. 4 and 5 of the drawings illustrate an alternate embodiment of an access door apparatus constructed in accordance with the invention. This second embodiment identified generally by reference 85 is similar to the access door apparatus 10 except for the differences described hereinafter. The access door 85 also has a panel or door 86 and a door frame 88 and a pivotable connecting frame arrangement joins the panel to the door frame. However, in this access door there is no central hole in the panel and no fastener such as a screw extending through the centre of the panel. Instead, there are a number of fastening devices 90, for example screws, for detachably connecting the panel 86 to the door frame 88 when the panel is in the closed position whereby the panel is securely held in the closed position. The fasteners or screws 90 extend through countersunk holes 92 formed near edges of the panel. In the closed position of the panel, the screws 90 are aligned with suitable threaded holes 94 provided on inwardly extending tabs or lugs formed on the door frame. The lugs 96 extend only a short distance into the access opening 16 and can be integrally formed on the door frame. It will be understood that the holes 94 can be located at any suitable location on the door frame and can, for example, be located in the outwardly extending flanges 72, if desired. Instead of the illustrated screws 90, it is also possible to use latch members of known construction which can be simply inserted and turned to secure the panel in place.

Also illustrated in FIGS. 4 and 5 is an alternative construction for attaching the access door apparatus to the wall panel or a ceiling panel 24. In this construction, the door frame is firmly attached to the panel by means of angular or L-shaped clips 100 or alternatively elongate angle brackets and suitable attachment screws 102 which extend through threaded holes formed in the clip or the angle member. Each screw 102 extends through the exterior flange 72 formed on the door frame with the head of each screw pressed against this flange. By turning the screw 102 clockwise, the clips or brackets 100 are drawn towards the adjacent section of the flange 72. By using clips or angle brackets in this manner, the adjacent edge of the panel is firmly clamped between the clip or angle member and the exterior flange 72 and thus a firm and strong connection is formed. This type of clamp connection can be used if there are no strong structural or frame members arranged around the opening. A connection of this type is also shown on the right side of FIG. 3.

A significant feature of the access door apparatus as illustrated both in FIGS. 1 to 3 and in FIGS. 4 and 5 is the ability of the panel member to pivot freely on the connecting links 34, 36 when these links are stationary and are in a position where the outer ends thereof are away from the access opening 16. It will in particular be noted that the panel or door 14 is free to pivot either clockwise or counterclockwise about the outer ends of the connecting links. This is significant because it allows more open and better access through the opening 16 than would be the case if the panel member could not pivot relative to the links when the links are brought to the position shown in FIG. 1, for example. To explain further, the panel 14 in the open position need not necessarily be in the position shown in FIG. 3 but it can also be arranged so that it extends parallel to the links. In addition, it will be appreciated that it is possible to swing the panel 14 to a position where it is on the opposite side of the access opening from that shown in FIG. 3. This can be done, for example, by arranging the panel parallel to the links and then swinging the links clockwise from the position shown in FIG. 3 to the maximum extent allowed. This in turn will permit good access to the left side of the opening 16 as shown in FIG. 3. This may be desirable, for example, to install the screws on the left side for purposes of attaching the door frame to the support 20.

It is also possible to use a variety of other means for holding the panel member or door in place in the closed position. For example, it is possible to incorporate into the door apparatus a simple locking device such as a latch rather than using the described screws. This latch can, for example, take the form of a sliding bolt member mounted on either the door panel or on the door frame and the provision of a suitable hole or bracket into which the end of the bolt slides in order to secure the panel in place. Another form of holding means would be a spring such as a coil spring which can be mounted so as to bias the panel or door towards either the connecting frame arrangement or the door frame or a spring can be arranged to pull the connecting frame arrangement itself towards the door frame. Either arrangement can result in the spring pulling the door panel into a closed position with a tight fit between the panel and either the door frame or the adjacent wall surface.

Figure 6:
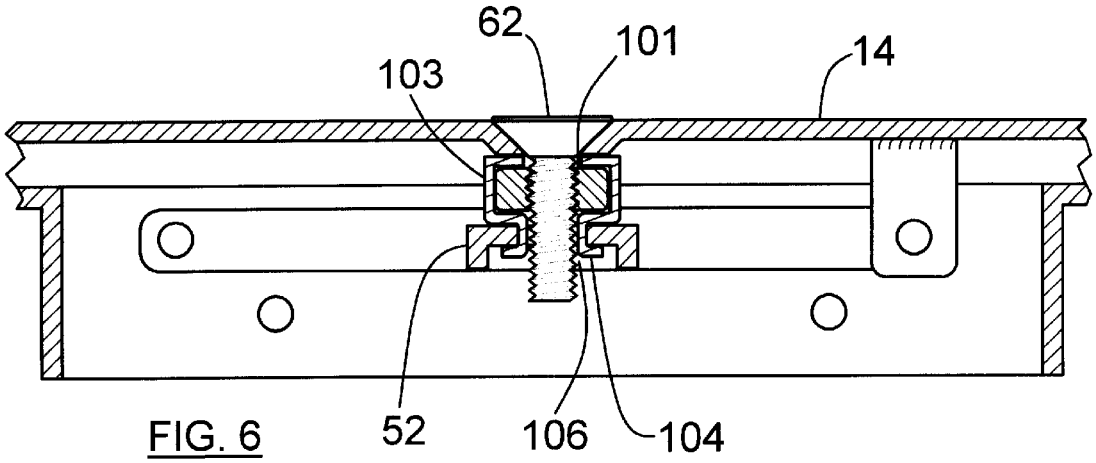
FIG. 6 is a cross-sectional detail view similar to FIG. 2 but showing the use of a nut retainer to hold a central panel-holding screw in place.

FIG. 6 illustrates the use of a nut retainer 101 mounted on the outside surface of the rigid frame member 52. It is also quite possible to mount this nut retainer on the inside surface of the frame member 52. The nut retainer is an efficient and inexpensive way to hold the central screw 62 that is used to hold the panel 14 in the closed position shown. The nut retainer is held in place and held against rotation by a nut housing 103 that extends about the perimeter of the nut retainer 101 which has a threaded hole to receive the screw. The housing 103 is formed with connecting flanges or tabs 104 that engage the inner surface of the frame member 52 which has a central hole 106 through which the threaded end of the screw extends.

From the above description of preferred embodiments, it will be seen that an access door apparatus constructed in accordance with the invention can be made easily and inexpensively and these devices can have a clean aesthetic appearance, particularly when the panel member is in the closed position. Moreover, it will be seen that these access doors can generally be installed easily by carpenters or other builders or even by homeowners themselves using simple tools.

It will be understood that various modifications and changes can be made to the described embodiments without departing from the spirit and scope of this invention. Accordingly, all such modifications and changes as fall within the scope of the appended claims are intended to be included in this invention.

What is claimed is:

1. An access door apparatus for installation in a structure such as a building, said access door apparatus comprising:

a door frame adapted for mounting in a fixed manner in said structure and forming an access opening;

a removable panel for covering said access opening on an exterior side of said door frame; and a pivotable connecting frame arrangement joining said panel to said door frame and having inner and outer ends which are respectively pivotably connected to said door frame and to said panel, said frame arrangement including two, substantially parallel connecting links pivotably connected to opposite sides of said door frame and to said panel and an interconnecting frame member that extends between and rigidly interconnects said two links; and a fastening mechanism for detachably connecting said panel to said connecting frame arrangement when said panel is in the closed position, wherein said panel can be moved from an open position where said access opening is at least substantially uncovered and open to said closed position where said panel covers said access opening in a close fitting manner and said panel can be secured in said closed position by said fastening mechanism.

2. An access door according to claim 1 wherein said panel and said door frame are substantially rectangular when they are viewed from a front side and said panel has a width and a length which are longer than corresponding outside dimensions of said door frame so that said panel covers said door frame in the closed position thereof.

3. An access door according to claim 2 wherein said panel has an edge section extending around a periphery of the panel, said edge section extending inwardly a distance measured perpendicularly to an inner face of said panel which is at least as large as the thickness of an outwardly extending flange formed on said door frame, said flange being arranged so as to extend over an exterior surface of said structure during use of said access door.

4. An access door according to claim 1 wherein said door frame has an external mounting flange formed thereon and arranged so as to extend over an exterior surface of said structure during use of said access door, and said mounting flange is formed with screw holes to permit said door frame to be directly attached to said exterior surface by means of screws or nails.

5. An access door according to claim 1 wherein one of said links is connected to one side of said door frame on a first inner surface that extends along one side of said access opening and the other of said links is connected to an opposite side of said door frame on a second inner surface that extends along an opposite side of said access opening.

6. An access door according to claim 5 wherein said fastening mechanism includes a threaded fastener that can extend through a hole formed in said panel and through a threaded hole provided on said interconnecting frame member.

7. An access door according to claim 1 wherein said door frame has four sides with each side being substantially L-shaped in cross-section and formed with an inner wall adapted to extend into an opening in said structure and an exterior flange that extends outwardly away from said access opening and each connecting link is pivotably connected to a respective one of the inner walls on opposite sides of said access opening.

8. An access door according to claim 7 wherein said fastening mechanism includes a threaded fastener, that can extend through a hole formed in said panel, and a threaded hole provided on said interconnecting frame member.

9. An access door apparatus for covering an aperture in a structure in a manner that permits access through said aperture when required, said apparatus comprising:

a door frame adapted to be fixedly mounted at said aperture and to said structure, said door frame having frame walls extending around and defining an access opening;

a panel member capable of covering at least said access opening on an exterior side of said door frame and having at least one fastener hole formed therein;

two pivotable connecting links joining said panel member to two of said frame walls disposed on opposite sides of said access opening, each of said links having an inner end pivotably connected to an inner surface of its respective frame wall and an outer end pivotably connected to a respective lug provided on an inner surface of said panel member; and a rigid frame member extending between and rigidly connecting said two connecting links whereby the two connecting links pivot with each other, wherein said panel member can be moved from an open position where said access opening is uncovered and open to a closed position where said panel member covers said access opening and wherein during use of said apparatus at least one fastener extending through said at least one fastener hole can be used to secure said panel member in said closed position.

10. An access door according to claim 9 wherein said frame member is provided with a threaded hole and said at least one fastener is used to detachably connect said panel member to said frame member by means of said threaded hole when said panel member is in the closed position in order to secure said panel member in said closed position.

11. An access door according to claim 9 wherein screw holes are formed in said door frame and a plurality of said at least one fastener can be used to secure said panel member directly to said door frame when said panel member is in said closed position.

12. An access door according to claim 10 wherein said threaded hole is formed by a nut retainer mounted on said frame member.

13. An access door apparatus for covering an aperture in a structure in a manner which permits access through said aperture when required, said apparatus comprising:

a door frame adapted to be rigidly mounted at said aperture and to said structure, said frame extending around and defining an access opening;

a panel member capable of covering at least said access opening on a front side of said door frame and having pivot mounts provided thereon;

two connecting links each pivotably connected to a respective one of said pivot mounts at an outer end thereof, each pivotably connected to said door frame at an inner end thereof, and arranged so that the links are on opposite sides of said access opening, said links permitting said panel member to be moved from an open position where said access opening is completely uncovered and said panel member is spaced apart from said access opening to a closed position where said panel member covers said access opening, said panel member being free to pivot on the connecting links when said connecting links are stationary and are in a position where said outer ends thereof are away from said access opening;

a rigid frame member extending between and rigidly connecting said two links whereby the two links pivot with each other; and means for holding said panel member in said closed position, said holding means comprising at least one threaded fastener and a threaded hole provided on said rigid frame member.

14. An access door according to claim 13 wherein said panel member has a peripheral edge section that extends inwardly a selected distance measured perpendicular to an inner face of said panel member, said door frame has an exterior peripheral flange with a thickness not exceeding said selected distance, and said panel member has a width and a length which both exceed corresponding dimensions of said door frame so that said panel member covers said door frame in the closed position thereof.

15. An access door apparatus according to claim 13 including L-shaped clips for attaching said door frame to panelling defining said aperture in said structure during use of said apparatus and fastening devices for connecting said clips to said door frame.

16. An access door apparatus for covering an aperture in a structure in a manner which permits access through said aperture when required, said apparatus comprising:

a door frame adapted to be rigidly mounted at said aperture and to said structure, said frame extending around and defining an access opening;

a panel member capable of covering at least said access opening on a front side of said door frame and having pivot mounts provided thereon;

two connecting links each pivotably connected to a respective one of said pivot mounts at an outer end thereof, each pivotably connected to said door frame at an inner end thereof, and arranged so that the links are on opposite sides of said access opening, said links permitting said panel member to be moved from an open position where said access opening is completely uncovered and said panel member is spaced apart from said access opening to a closed position where said panel member covers said access opening, said panel member being free to pivot on the connecting links when said connecting links are stationary and are in a position where said outer ends thereof are away from said access opening; and means for holding said panel member in said closed position, said holding means comprising a plurality of threaded fasteners and a plurality of screw holes formed in said door frame and in said panel member, wherein said threaded fasteners and screw holes can be used to detachably connect said panel member to said door frame.

* * * * *